US009455516B2

(12) United States Patent
Gutenschwager et al.

(10) Patent No.: US 9,455,516 B2
(45) Date of Patent: Sep. 27, 2016

(54) CONTACT SOCKET FOR AN ELECTRICAL PLUG CONNECTOR

(71) Applicant: DELPHI TECHNOLOGIES, INC., Troy, MI (US)

(72) Inventors: Rainer Gutenschwager, Marl (DE); Karl Wirth, Pulheim (DE); Martina Panahi, Dortmund (DE); Eduard Cvasa, Bochum (DE)

(73) Assignee: Delphi Technologies, Inc., Troy, MI (US)

( * ) Notice: Subject to any disclaimer, the term of this patent is extended or adjusted under 35 U.S.C. 154(b) by 5 days.

(21) Appl. No.: 14/520,696

(22) Filed: Oct. 22, 2014

(65) Prior Publication Data

US 2015/0111443 A1 Apr. 23, 2015

(30) Foreign Application Priority Data

Oct. 23, 2013 (EP) ..... 13189848

(51) Int. Cl.
*H01R 13/187* (2006.01)
*H01R 43/26* (2006.01)
*H01R 43/16* (2006.01)

(52) U.S. Cl.
CPC ..... *H01R 13/187* (2013.01); *H01R 43/16* (2013.01); *H01R 43/26* (2013.01); *Y10T 29/49218* (2015.01)

(58) Field of Classification Search
CPC .... H01R 13/187; H01R 43/16; H01R 43/26; Y10T 29/49218
USPC ..... 439/486, 847, 842, 884, 843, 845
See application file for complete search history.

(56) References Cited

U.S. PATENT DOCUMENTS 5,415,571 A * 5/1995 Lutsch ..... H01R 13/187 439/252
5,419,723 A * 5/1995 Villiers ..... H01R 13/187 439/246
5,462,459 A * 10/1995 Childs ..... H01R 13/113 439/843
5,529,517 A * 6/1996 Hopf ..... H01R 13/11 439/374
5,685,746 A * 11/1997 Maejima ..... H01R 13/18 439/845
5,810,627 A * 9/1998 Gierut ..... H01R 13/187 439/843
5,897,404 A * 4/1999 Goodman ..... H01R 13/187 439/843
5,921,821 A * 7/1999 Oka ..... H01R 13/113 439/745
5,980,336 A * 11/1999 Hall ..... H01R 13/113 439/843
6,273,766 B1 * 8/2001 Zennamo, Jr. ..... H01R 13/187 439/843
6,394,858 B1 * 5/2002 Geltsch ..... H01R 13/187 439/843

(Continued)

FOREIGN PATENT DOCUMENTS

DE 202008004957 U1 7/2008
EP 784356 A1 3/2000

(Continued)

OTHER PUBLICATIONS

European Patent Search Report EP13189848, published Jan. 10, 2014.

*Primary Examiner* — Abdullah Riyami
*Assistant Examiner* — Nelson R Burgos-Guntin
(74) *Attorney, Agent, or Firm* — Robert J Myers

(57) ABSTRACT

An electrical connector having a female part with a socket portion configured for receiving a male part in the socket portion. The male part comprises openings in the area of the base and the socket portion comprises projections protruding into the openings. The projections in the openings are form-fittingly connected to the male part.

13 Claims, 5 Drawing Sheets

(56) References Cited

U.S. PATENT DOCUMENTS 6,872,103 B1 * 3/2005 Flieger ..... H01R 13/18 439/752.5
7,294,027 B1 * 11/2007 Tyler ..... H01R 13/187 439/845
7,300,319 B2 * 11/2007 Lutsch ..... H01R 4/185 439/845
7,465,199 B2 * 12/2008 Osada ..... H01R 4/185 439/845
7,556,542 B2 * 7/2009 Lischeck ..... H01R 13/18 439/845
2003/0096540 A1 * 5/2003 Smyk ..... H01R 13/187 439/843
2003/0162447 A1 * 8/2003 Beloritsky ..... H01R 13/187 439/843
2004/0014370 A1 * 1/2004 Zhao ..... H01R 11/22 439/843
2004/0116002 A1 * 6/2004 Rozet ..... H01R 13/187 439/843
2006/0014442 A1 * 1/2006 Allgood ..... H01R 11/289 439/843
2006/0252294 A1 * 11/2006 Cvasa ..... H01R 13/187 439/252

FOREIGN PATENT DOCUMENTS

FR 2639770 A1 6/1990
WO 2012176936 A1 12/2012

* cited by examiner

CONTACT SOCKET FOR AN ELECTRICAL PLUG CONNECTOR

CROSS-REFERENCE TO RELATED APPLICATION

This application claims the benefit under 35 U.S.C. §119 (a) of European Patent Application EP 13189848.8, filed on Oct. 23, 2013, the entire disclosure of which is hereby incorporated by reference.

TECHNICAL FIELD OF THE INVENTION

The invention relates to an electrical connector having a female part having a socket portion for receiving a plug contact, and a male part inserted into the socket portion for contacting a plug contact inserted into the female part.

BACKGROUND OF THE INVENTION

A connector formed in two pieces is known in principle. While the male part inserted into the socket portion is provided for contacting a plug contact inserted into the socket portion, the female part is typically configured such that the connector may be connected to an electrical wire. Thus, the electrical path from the wire to the plug contact leads through the female part and the male part. In the known connector, the male part and the female part are welded together for establishing an improved electrical and mechanical connection. The welded joint may be formed, e.g. by a laser welding method, to be point-like at various locations. The connector may then be connected with an electrical conductor, e.g. an electric wire. When assembling connectors to electrical wires, often ultrasonic-based connecting techniques are used. However, the connector, having been improved by means of welded joints, is sensitive to vibrations. The welding points may break due to the vibrations which occur during ultrasonic welding and also continue to the welding points at the connector. The breaking of the welding points cannot be predicted and changes the electrical and mechanical characteristics of the connector. This renders it impossible to maintain standards of quality when assembling wires.

BRIEF SUMMARY OF THE INVENTION

The invention has the object to provide an electrical connector of the type mentioned above, which is insensitive to vibration, withstands an increased current flow and at the same time can be produced at lower economic cost.

In accordance with a first embodiment of the invention, an electrical connector having a female part with a socket portion configured for receiving a male part in the socket portion is provided. The male part comprises openings in the area of the base and the socket portion comprises projections protruding into the openings, wherein the projections in the openings are form-fittingly connected to the male part.

In accordance with a second embodiment, an electrical connector wherein an elastic notch projection is formed from a part of the wall of the socket portion protruding outwardly is provided.

In accordance with a third embodiment, an electrical connector wherein at least one side of the notch projection a lug is formed to extend into a wall opening of the socket portion is provided.

In accordance with a fourth embodiment, an electrical connector wherein the wall opening is greater than the lug, so that the notch projection is movable is provided.

In accordance with a fifth embodiment, an electrical connector wherein the male part includes at least one contact spring arm resilient at its distal end, which is adapted to abut the inner surface of the female part, is provided.

In accordance with a sixth embodiment, an electrical connector wherein the male part is configured in a sleeve-shape is provided.

In accordance with a seventh embodiment, an electrical connector wherein the female part in its interior comprises a holding notch cooperating with a mounting hole of the male part is provided.

In accordance with an eighth embodiment, an electrical connector wherein the male part on its inside comprises at least one embossment is provided.

In accordance with a ninth embodiment, an electrical connector wherein the female part and the male part are of different metals or alloys is provided.

In accordance with a tenth embodiment, an electrical connector wherein the female part and the male part have different wall thicknesses is provided.

In accordance with an eleventh embodiment, a method for manufacturing a connector comprising the steps of providing a female part comprising at one end a hollow space and projections, and inserting a male part having openings into the female part, wherein the male and female parts are aligned such that the projections extend into the openings, deforming the projections is provided.

In accordance with a twelfth embodiment, a method for manufacturing a connector wherein the material of the projections is deformed such that the thickness of the material of the stamped surfaces substantially corresponds to the thickness of the material of the male part is provided.

In accordance with a thirteenth embodiment, a method for manufacturing a connector wherein the projections are bent into the openings when being aligned is provided.

In accordance with a fourteenth embodiment, a method for manufacturing a connector wherein the material of the projections is deformed such that the projections extending into the openings are connected form-fittingly with the male part in the openings is provided.

In accordance with a fifteenth embodiment, an electrical wire comprising an electrical connector and an electrical conductor is provided.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

In the following, embodiments of the invention will be described in more detail. Similar or corresponding details of the subject matter according to the invention are provided with the same reference numbers.

Figure 1:
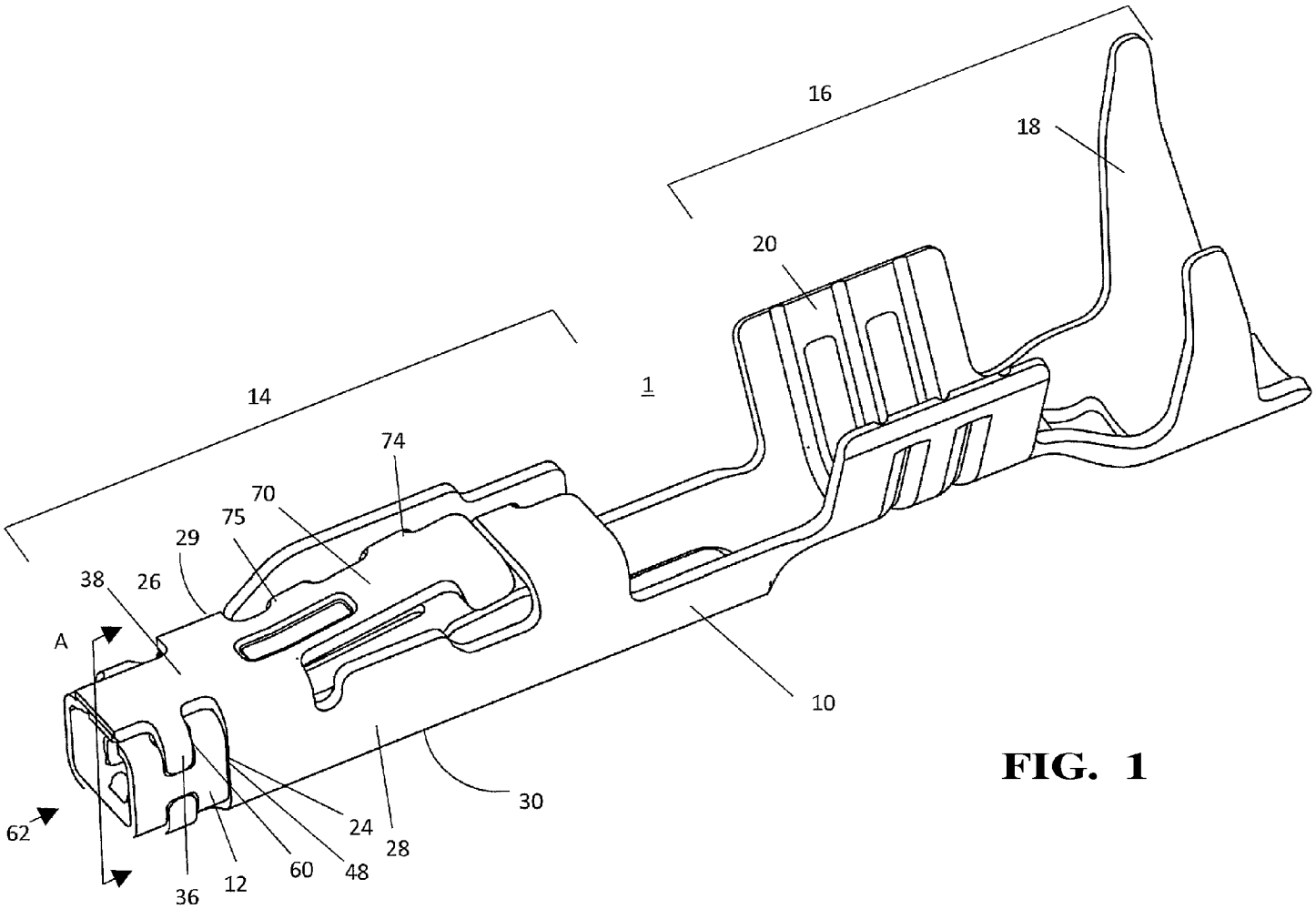
FIG. 1 is a perspective view of a connector according to a first embodiment.
Figure 2:
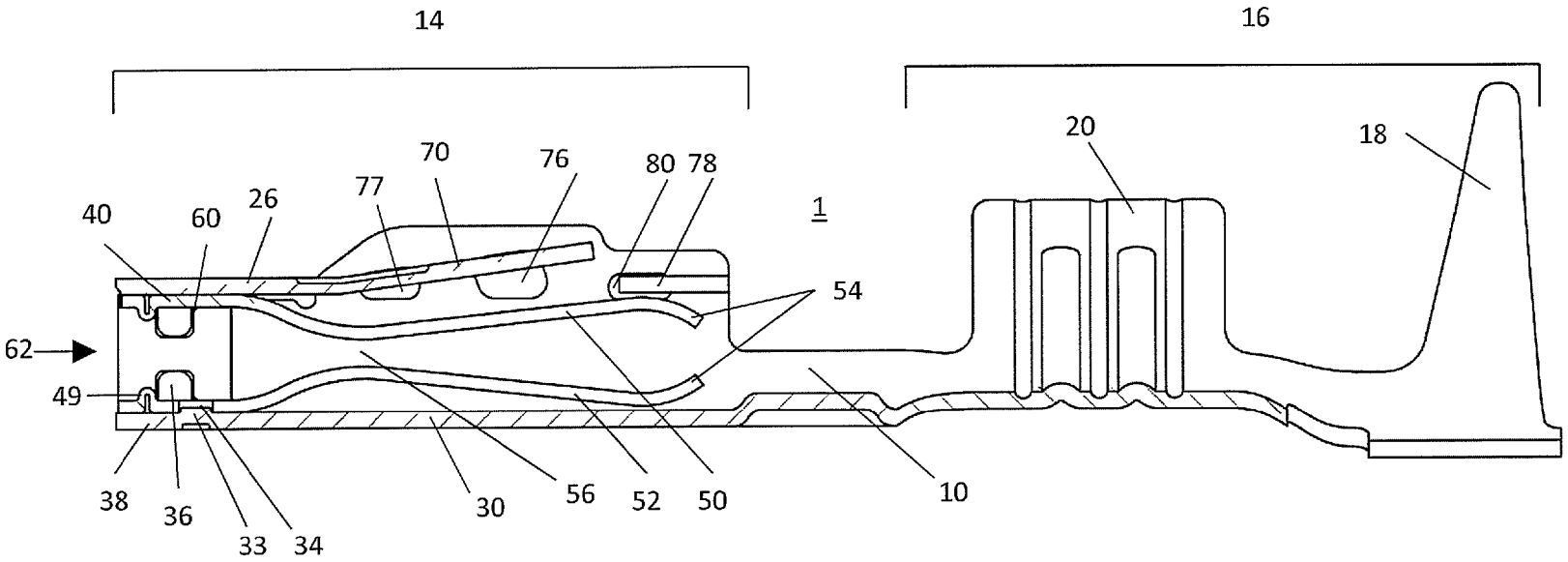
FIG. 2 is a section along the longitudinal axis of the connector.

The connector 1 according to the invention, shown in FIGS. 1 and 2, is an electrical connector having two pieces, which includes a female part 10 and a male part 12. The female part 10 and the male part 12 are each formed as a stamped and bent part and each comprise an electrically conductive material.

As shown in FIG. 1, the female part 10 includes a socket portion 14 for receiving a plug contact, not shown, and a crimping portion 16 having first and second crimping tabs 18, 20 for electrical and mechanical connection of the connector 1 with an electrical wire (not shown). The male part 12 is inserted into the socket portion 14. The female part 10 comprises two bridges 38 in the socket portion 14 which extend from two opposite side walls 26, 30 in direction of the insertion opening 62. Projections 36 extend from said bridges 38 perpendicular to the plug direction. The male part 12 is located between the bridges 38. The male part 12 is inserted into the socket portion 14 such that it abuts the abutting surface 24 of the socket portion with an abutting surface 48. The projections 36 are inwardly bent such that they extend into the openings 44 of the base 40 of the male part 12 and are press-fit stemmed therein. The projections 36, after being press-fit stemmed, are connected to one another in the holding areas 60, where the stamped surfaces 22, 46 of the projections 36 and openings 44 are oppositely arranged.

FIG. 2 shows a sectional view of the connector 1 along the section axis A. The male part 12 is arranged with its base 40 between the bridges 38 of the female part 10. Two contact spring arms 50, 52 extend from the base 40 opposite the insertion opening 62. Starting from the base 40, the contact spring arms 50, 52 run toward each other in the direction of their free ends 54. In a contact region 56 provided for electrical and mechanical contacting of a plug contact (not shown), inserted into the socket portion 14, the contact spring arms 50, 52 are at a minimum distance from each another. In the area of the contact region 56, the contact spring arms 50, 52 are each provided with a longitudinal gap 58 extending in the plug-in direction, which results in a plug contact (not shown) inserted into the socket portion 14 being contacted in a total of four different areas by the contact spring arms 50, 52, and thereby the reliability of the contact is increased. Starting from the contact region 56, the contact spring arms 50, 52 run apart from each other in the direction of their free ends 54 to facilitate insertion of a plug contact. The contact spring arms 50, 52 are pushed against the inner sides of the female part 10 when the plug contact is inserted, thereby providing additional contact points between the male part 12 and the female part 10.

Figure 3:
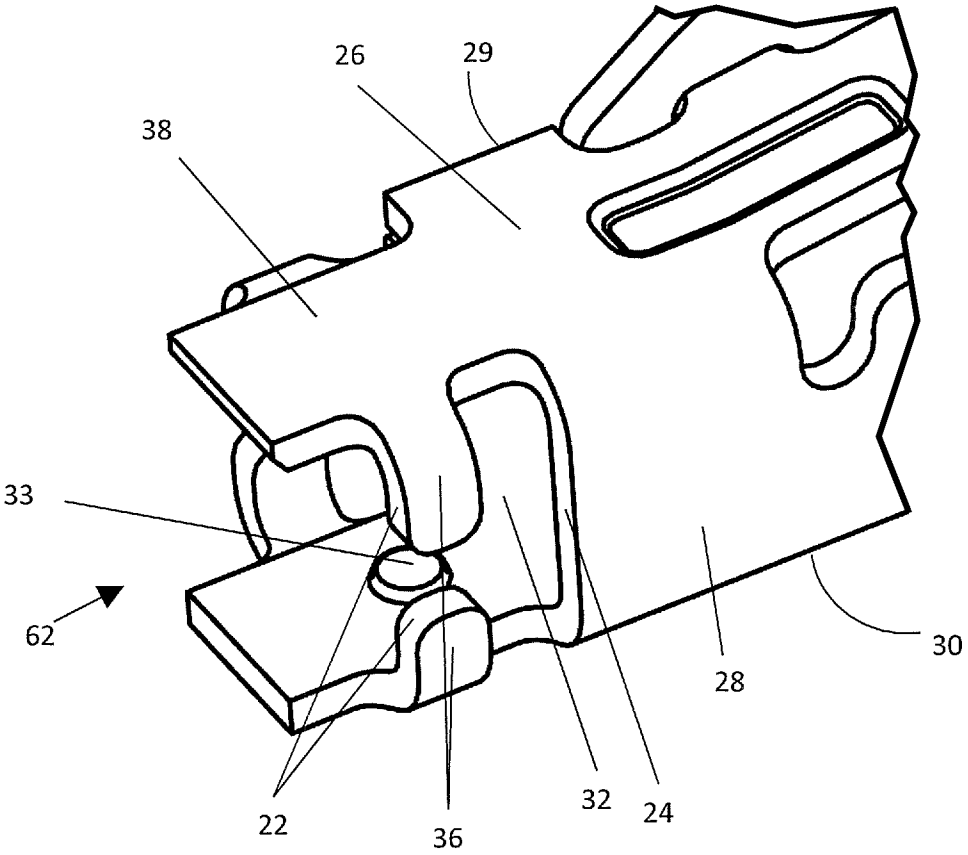
FIG. 3 is a perspective view of a portion of the socket portion near the insertion opening according to the first embodiment (without male part)
Figure 4:
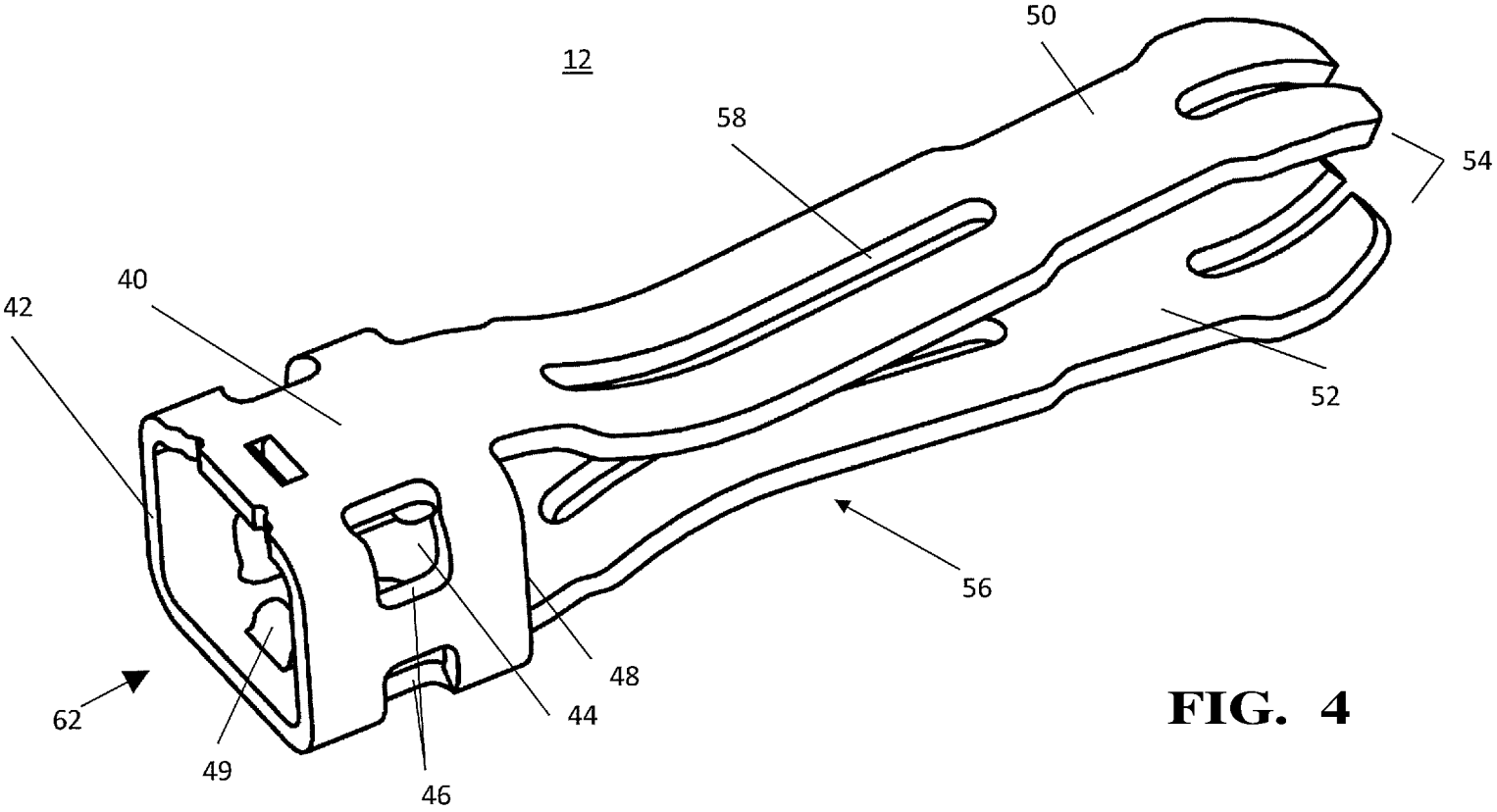
FIG. 4 is a perspective view of a male part according to the first embodiment.

As is shown in FIGS. 3 and 4, the socket portion 14 has a substantially rectangular basic shape with an approximately square cross-section in the illustrated embodiment. The socket portion 14 includes four side walls 26, 28, 29, 30, which define a receiving space 32 for the plug contact and the male part 12. The base 40 also has a substantially rectangular basic shape with an approximately square cross-section such that it abuts the inner sides of the bridges 38, when the male part 12 is inserted into the female part 10. The base 40 includes four side walls 42 with openings 44 in the side walls 42. The projections 36 and the openings 44 have a rectangular shape in this embodiment. The stamped surfaces 22 surrounding the projections 36 are opposite to the stamped surfaces of the openings 44 of the base 40 when the male part 12 is inserted and the projections 36 are bent. After the male part 12 is inserted into the socket portion 14 and the projections 36 of the socket portion 14 project into the openings 44 of the base 40, still no form-fitting connection between the socket portion 14 and the male part 12 is established. There is still a small gap between the parts. By using a mechanical procedure, pressure is applied to the projections 36 to deform the material. The pressure is applied in such a way that the wall thickness of the projections 36 is reduced at the locations of the pressure impingement and the metal flows in the direction of the stamped edges. The flow process is terminated when the stamped surfaces 22 of the projection 36 abuts against the stamped surfaces 46 of the openings 44 of the base 40. When the material with pressure applied is no longer able to flow, the surfaces are pressed together. This condition persists even after removing the pressure and holds the parts together. This procedure is known under the name of press-fit stemming. Press-fit stemming in mechanics refers to establishing a force- and form-fitting connection between two individual work pieces by plastic deformation.

Figure 5:
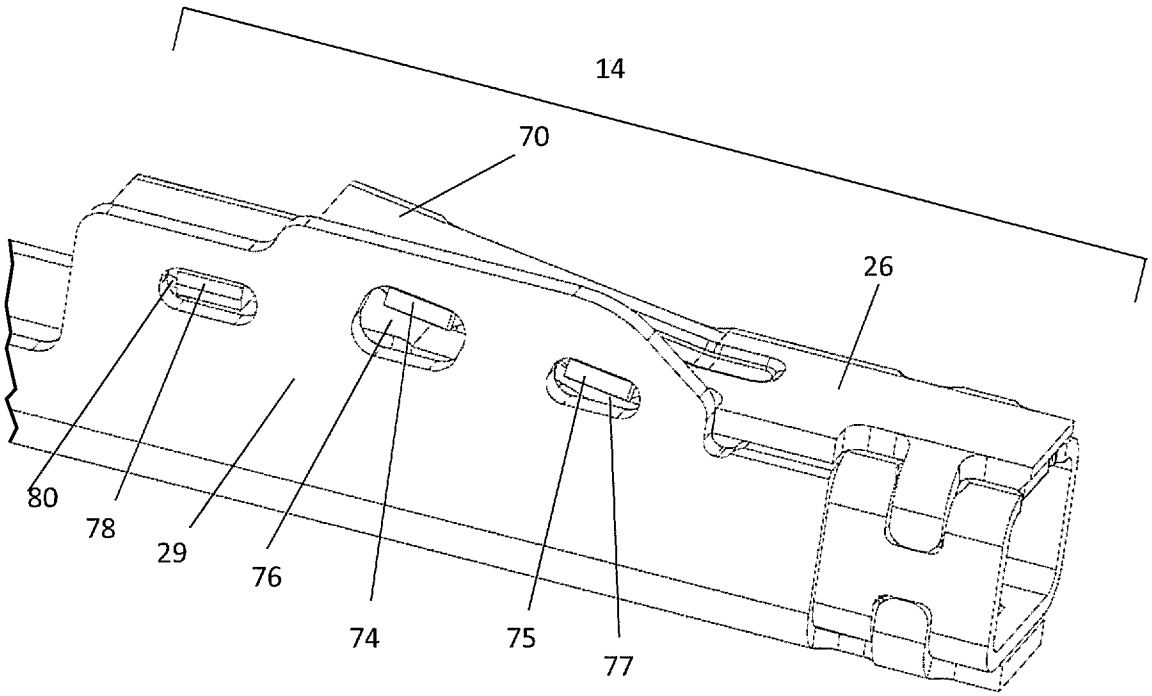
FIG. 5 is a perspective view of the socket portion.

FIG. 5 shows that the socket portion 14 has been formed of four side walls 26, 28, 29, 30 to a box-shaped socket portion. The side walls of the sheet-sections forming the box were formed by three 90° bends to a closed outer surface. The outer edge, closing the box after bending, is connected by a laterally projecting tab 78, which projects into a window 80 in a side wall 29, thereto by press fitting. A notch projection 70 is formed from the upper side wall 26 by cutting a strip of the side wall 26, wherein a portion remains connected with the upper side wall 26. Thereby the notch projection 70 is moveable against the upper side wall 26. A first lug 74 and a second lug 75 are formed on one side of the notch projection 70, which project in a first side wall opening 76 and a second side wall opening 77, respectively. The side wall openings 76, 77 are dimensioned such that the lugs 74, 75 have a small distance to the edges of the side wall openings 76, 77. Thereby, the lugs 74, 75 are able to move within the side wall openings 76, 77. Thus, the range of movement of the notch projection 70 is determined by the sizes of the lugs 75, 75 and the side wall openings. The notch projection 70 is bent outwardly at the end with which it is not attached to the upper side wall, as far as the side wall openings 76, 77 allow. Upon insertion of the connector 1 into a housing (not shown), the notch projection 70 may move inward and when the connection element has reached the final position in the housing, may move outwards and hold the connector 1 in the housing chamber (not shown). The pull-out force needed to pull out unintentionally increases compared to a conventional notch device, since the lugs 74, 75 of the notch projection 70 are held in the side wall openings 76, 77 and thus prevents the notch projection 70 from being bent.

As can be seen in FIGS. 2 and 3, the female part comprises a holding notch 33 in a bridge 38, which cooperates with a mounting hole 34 in the base 40 to prevent unintended shifting of the male part in the female part, as long as the projections 36 are not bent into the openings 44 during manufacture. When the male part 12 is inserted, the holding notch 33 projects into the mounting hole 34 and thus prevents the unintended shifting of the male part 12.

FIG. 4 shows that the male part 12 within the base 40 comprises a domed embossment 49 in a side wall, which serves as an insertion aid for a plug contact (not shown). If the plug contact is not centered into the insertion opening 62, it abuts against the embossment 49 and is guided by the domed shape into a more advantageous insertion position.

The base of the male part is not provided for contacting a plug contact inserted into the socket portion. Therefore, it can be formed independently of the design of the contact spring arms for a stable connection to the socket portion. During stemming, the two parts are connected with each other, area by area at their stamped surfaces. This results in a relatively large contact surface between the parts. This not only provides a secure mechanical connection between the male part and the female part, but also an improved electrical and thermal coupling of the male part and the female part in comparison to a welded joint. Thus, greater currents can flow through the connection without substantially heating the connector in the area of the connection. Consequently, the maximum current that can flow through the inventive connector is much higher than for a connector with insertion part and the receiving part welded together.

In addition, the disclosed connection can be manufactured much easier than a connector with a welded joint. In particular, one does not have to invest in a welding device, e.g. a laser welding device. Instead, the stemming connection may be manufactured for example by a stamping and bending apparatus which is also used for producing the male part and the female part. The reduced investment costs contribute to the fact that the connector according to the invention may be produced with lower economic cost.

According to one embodiment the female part and the male part may be formed as a stamped and bent part, which contributes to a cost-effective production. The male part and the female part are connected only at stamped surfaces whereby no additional holding devices or contacting devices need to be provided. Thus, a connector free from parts projecting into the receiving area may be provided, which reduces the overall cross-section of the connector.

Preferably, the female part and the male part are made of different metals or alloys, since the requirements for the male part are to safely and permanently contact a complementary contact part which is inserted into the connector, whereas the female part is provided for holding the male part and for providing the contact with a conductor (electrical wire) and for fixing the connector in a housing. Preferred materials for the male part are for example copper-nickel-silicon alloys, since they have particularly good elastic characteristics. The female part can be manufactured inexpensively from a sheet of bronze, wherein a good electrical conductivity is ensured between the male part and the electrical wire.

Preferably, the female part and the male part may have different wall thicknesses. The female part may have a slightly greater wall thickness than the male part. This has the effect that the wall thicknesses at the stamped edges of the two parts are approximately the same after stemming. This is advantageous since then the entire contact surface between the parts may be used for holding and electrical contacting. In addition, no corners exist where dirt can collect, leading to corrosion. A promising combination comprises a male part having a material thickness of 0.15 mm and a material thickness of 0.20 mm for the female part. It would also be conceivable to use equal wall thicknesses and to configure the stemming process such that the wall thickness is maintained at the stamped surfaces and the material gets thinner at other locations. However, this process is possibly difficult to control in production.

According to a further embodiment, the electrical contacting of the socket portion and the male part is carried out mainly through the stamped surfaces of the two parts, since in this way a large contact area is obtained, which has a low electrical resistance and is substantially resistant to corrosion, since moisture cannot get into the separation surface. Further secondary current paths arise when portions of the male part are pressed against the female part after a plug contact is inserted into the connector. The additional connection locations between the male part and the female part further reduce the total resistance of the connector.

Preferably, the male base forms the insertion opening of the socket portion such that the area that represents the insertion opening for the complementary plug contact may be adapted to the plug contact to optimally guide it into the male part when being connected.

According to a further embodiment, the female part and the projections are integrally formed from sheet metal. The female part is stamped from sheet metal and folded into shape. Thereby, cost-efficient production is possible. The male part may also be stampeded out of sheet metal and brought in shape. The openings of the male part are introduced in the male part during stamping.

Preferably, the projections project from one or more side walls of the socket portion, so that they may be fitted into the openings of the male part. The arrangement of the projections can be realized in a wide variety. A requirement for this is, however, that a projection needs to be arranged such that it projects into an opening in the wall of the male part, and may be able to be fixed in said opening by press-fit stemming and to be electrically contacted.

According to a further embodiment, the projections from a side wall of the socket portion may project in connecting direction or perpendicular to the connecting direction. As mentioned above, the projections may project at different angles from the female part. The socket portion may comprise side walls prolonged to bridges which are suitable to mechanically support the male part. Said bridges extend from the side walls. From the bridges, in turn, the projections extend. In this embodiment, after insertion of the male part, the projections do not project into the openings but are bent into the openings prior to stemming. This structure increases the mechanical stability of the connector.

Preferably, the socket portion has a rectangular or square cross-section such that it may be supported in a housing without being distorted. However, it is conceivable to provide a socket portion having a circular or oval cross-section and to form the male part correspondingly.

LIST OF REFERENCE NUMERALS

1 Connector
10 Female part
12 Male part
14 Socket portion
16 Crimping portion
18 First crimping tab
20 Second crimping tab
22 Stamped surface
24 Abutting surface
26 Upper side wall
28 Sidewall
29 Sidewall
30 Sidewall
33 Holding notch
32 Receiving space
34 Mounting hole
36 Projection
38 Bridge
40 Base
42 Sidewalls
44 Openings
46 Stamped surfaces
49 Embossment

48 Abutting surface
50 Contact spring arm
52 Contact spring arm
54 Free ends
56 Contact region
58 Longitudinal gap
60 Holding areas
62 Insertion opening
70 Notch projection
74 First lug
75 Second lug
76 First side wall opening
77 Second side wall opening
78 Laterally projecting tab
80 Window

We claim:

1. An electrical connector, comprising:

a female part formed from a first alloy and having a socket portion and a crimping portion, wherein the crimping portion defines first and second crimping tabs for electrical and mechanical connection of the electrical connector with an electrical wire; and a male part formed from a second alloy different from the first alloy and defining openings in a base of the male part, wherein the male part is received within the socket portion of the female part, wherein the socket portion has projections protruding into the openings, and wherein the projections in the openings are form-fittingly connected to the male part;

wherein the male part includes a plurality of contact spring arms projecting from the base.

2. The electrical connector according to claim 1, wherein an elastic notch projection is formed from a part of a wall of the socket portion, protruding outwardly.

3. The electrical connector according to claim 2, wherein at one side of the elastic notch projection, a lug is formed to extend into a wall opening of the socket portion.

4. The electrical connector according to claim 3, wherein the wall opening is greater than the lug, so that the elastic notch projection is movable.

5. The electrical connector according to claim 1, wherein the male part is configured in a sleeve-shape.

6. The electrical connector according to claim 1, wherein the female part comprises a holding notch in its interior cooperating with a mounting hole of the male part.

7. The electrical connector according to claim 1, wherein the male part comprises an embossment on its inside.

8. The electrical connector according to claim 1, wherein the female part and the male part have different wall thicknesses.

9. A method for manufacturing a connector, comprising the steps of:

providing a female part formed from a first alloy and comprising a hollow space and projections at one end and a crimping portion having first and second crimping tabs for electrical and mechanical connection of the electrical connector with an electrical wire at the other end; and inserting a male part formed from a second alloy different from the first alloy and having openings into the female part, wherein the male and female parts are aligned such that the projections extend into the openings, thereby deforming the projections; wherein the male part includes a plurality of contact spring arms.

10. The method for manufacturing a connector according to claim 9, wherein the projections of the female part have stamped surfaces and wherein a material of the projections is deformed such that a thickness of the material of the stamped surfaces substantially corresponds to a thickness of the material of the male part.

11. The method for manufacturing a connector according to claim 9, wherein the projections are bent into the openings when being aligned.

12. The method for manufacturing a connector according to claim 9, wherein a material of the projections is deformed such that the projections extending into the openings are connected form-fittingly with the male part in the openings.

13. The electrical connector according to claim 1, wherein the first alloy is a bronze alloy and the second alloy is a copper-nickel-silicon alloy.

* * * * *